US007900448B2

(12) United States Patent
Pettersson

(10) Patent No.: US 7,900,448 B2
(45) Date of Patent: Mar. 8, 2011

(54) PULSE GENERATOR AND IMPULSE MACHINE FOR A CUTTING TOOL

(75) Inventor: Maria Pettersson, Stora Mellösa (SE)

(73) Assignee: Atlas Copco Rock Drills AB, Orebro (SE)

( * ) Notice: Subject to any disclaimer, the term of this patent is extended or adjusted under 35 U.S.C. 154(b) by 518 days.

(21) Appl. No.: 12/084,795

(22) PCT Filed: Dec. 8, 2006

(86) PCT No.: PCT/SE2006/001401

§ 371 (c)(1), (2), (4) Date: May 9, 2008

(87) PCT Pub. No.: WO2007/073276

PCT Pub. Date: Jun. 28, 2007

(65) Prior Publication Data

US 2009/0173070 A1 Jul. 9, 2009

(30) Foreign Application Priority Data

Dec. 22, 2005 (SE) ..... 0502914

(51) Int. Cl.
*B25D 9/06* (2006.01)
*F15B 7/02* (2006.01)

(52) U.S. Cl. ..... 60/537; 173/200

(58) Field of Classification Search ..... 60/532, 60/537, 543, 473; 92/12.1; 173/200
See application file for complete search history.

(56) References Cited

U.S. PATENT DOCUMENTS 6,510,779 B2 * 1/2003 Greene et al. ..... 91/504

FOREIGN PATENT DOCUMENTS

| | | |
|---|---|---|
| DE | 2909297 | 9/1980 |
| EP | 0918176 | 5/1999 |
| RU | 2182967 | 5/2002 |
| WO | 2004 073933 | 9/2004 |
| WO | 2005 002801 | 1/2005 |
| WO | 2005 002802 | 1/2005 |
| WO | WO 2005002801 A1 * | 1/2005 |

* cited by examiner

*Primary Examiner* — Thomas E Lazo
(74) *Attorney, Agent, or Firm* — Mark P. Stone

(57) ABSTRACT

The invention relates to a pulse generator (18) in an impulse generator (2) for a cutting tool (12), which pulse generator (18) is intended to transfer energy from a propulsion device (14) to impulses in the tool (12), where the pulse generator (18) comprises a rotatable cylinder drum (28) comprising at least one piston cylinder (30, 86, 88, 90, 92, 94, 96, 98), in which piston cylinder (30, 86, 88, 90, 92, 94, 96, 98) is arranged at least one piston (32, 87, 89, 91, 93, 95, 97, 99), which piston (32, 87, 89, 91, 93, 95, 97, 99) is arranged to compress fluid (29) during rotation of the cylinder drum (28), and that the cylinder drum (28) is arranged to discharge the fluid (29) to the propulsion chamber (6) in the discharge position of the piston (32, 87, 89, 91, 93, 95, 97, 99) via at least one opening (31, 72, 74, 76, 78, 80, 82, 84) opening into the piston cylinder in order to produce an impulse in the tool (12). The invention also relates to an impulse machine comprising an impulse generator (2).

20 Claims, 5 Drawing Sheets

PULSE GENERATOR AND IMPULSE MACHINE FOR A CUTTING TOOL

TECHNICAL FIELD

The present invention relates to a pulse generator in an impulse generator for a cutting, for example a rock breaking, tool, and an impulse machine comprising a pulse generator.

BACKGROUND

In traditional machines with striking mechanisms a piston which pneumatically or hydraulically is made to move back and forth in a propulsion chamber is used, where the piston strikes directly or indirectly via for example a drill steel shank against the end of a drilling steel which in turn bears on the rock via a drill bit. The stress pulse provides forces at the contact with the rock that makes the rock break.

Efforts have been made with rock breaking machines which contrary to the traditional machines with striking mechanisms have a piston that does not move as far back and forth in the propulsion chamber for transfer of the impact force which brings about a possibility to increase the impact frequency.

WO 2005/002801 shows a striking device such as a rock drill, where a stress pulse is generated in a tool by means of the striking device by that pressure fluid is fed to the striking device and is fed out from the striking device. The pressure fluid that is fed to the striking device is pulsed to a working chamber in the striking device.

If one in a device of the above mentioned type wants to adapt the energy in the stress pulse which is generated in a tool to that which is required to work the rock, one can vary the level of the pressure which is fed to the striking device. However, the pump and the hoses limit the range within which the pressure can be varied.

BRIEF DESCRIPTION OF THE INVENTION

The problem to adapt the energy in the delivered pulse is solved according to the invention by arranging a pulse generator in an impulse generator for a rock breaking tool, which pulse generator is designed to transfer energy from a propulsion device to impulses in the tool, where the pulse generator comprises a rotatable cylinder drum comprising at least one piston cylinder, in which piston cylinder is arranged at least one piston, which piston is arranged to compress fluid during rotation of the cylinder drum, and that the cylinder drum is arranged to at the discharge position of the piston to discharge the fluid to the propulsion chamber via at least one into the piston cylinder leading opening in order to produce an impulse in the tool.

By that the pulse generator comprises the characteristics in claim 1, the advantage of producing an impulse generator where the energy in the to the tool delivered pulse can be adapted in a simpler way is attained.

BRIEF DESCRIPTION OF DRAWINGS

The invention will be described below in greater detail with reference to the attached drawings, in which.

DESCRIPTION OF PREFERRED EMBODIMENTS

Figure 1:
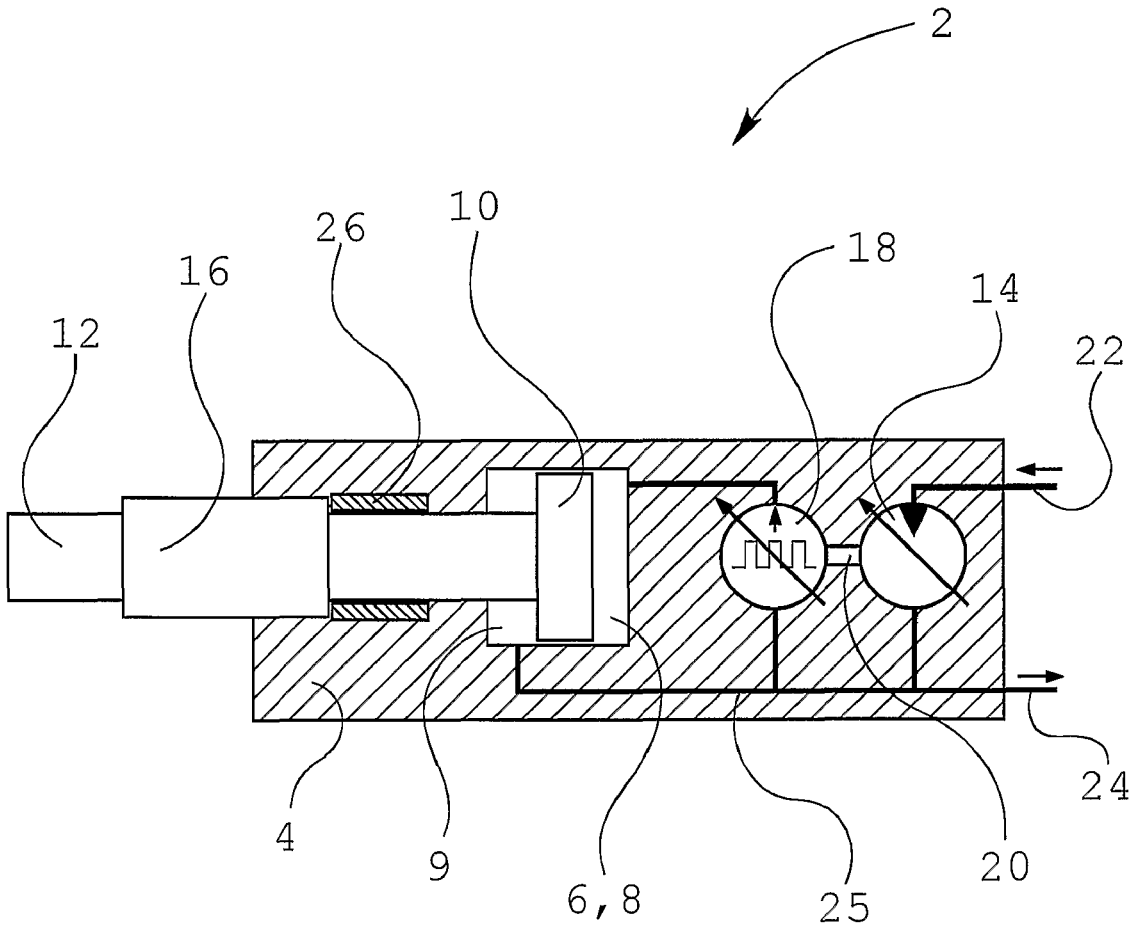
FIG. 1 shows schematically a longitudinal section of a first embodiment of an impulse generator.

FIG. 1 shows schematically a longitudinal section of a first embodiment of an impulse generator 2 comprising a housing 4 with a propulsion chamber 6 for receiving of a pressurizeable fluid volume 8, and an in the propulsion chamber 6 received impulse piston 10, where the impulse piston 10 is arranged for direct or indirect transfer of pressure peaks in the fluid volume 8 to impulses in a tool 12. If the impulse piston 10 is arranged adjacent to the tool 12, the impulses are transferred directly, but the impulses may also be transferred indirectly via for example an intermediate adapter 16. In the figure, the propulsion chamber 6 is shown in a position where the pressure in the fluid volume 8 in the propulsion chamber 6 is so low that the impulse piston 10 is situated in its rest position. The return movement of the impulse piston 10 to this rest position is effected for example by pressurizing a chamber 9 on the side of the impulse piston 10 opposite the side of the propulsion chamber 6 with air or fluid or by arranging a spring (not shown) in this space, or by moving the whole drilling rig with the thereon mounted impulse generator 2 forward against the rock in which case a damper 26 may be arranged to regulate the rest position. Optionally, a shoulder (not shown) may be arranged as a stop in the propulsion chamber 6 which however may be difficult in those cases where one obtains large reflections. Another conceivable solution is to use the impulse piston 10 as a part in a system for damping reflections and/or part in a system for rest position restoration. Further is shown a pulse generator 18, which is driven by the propulsion device 14 via a propulsion mechanism 20, which propulsion mechanism 20 preferably is a drive shaft. The propulsion device 14 may be arranged outside of the impulse generator 2, but is preferably arranged inside the impulse generator 2, which impulse generator 2 may for example be a drilling machine. The propulsion device 14 may for example be electrically or hydraulically driven, i.e. the propulsion device may for example be an electric motor or a hydraulic motor. For rock drilling, the impulse generator 2 may be cooled down with e.g. hydraulic fluid or drilling water via channels in the housing 4 of the impulse generator 2 or via on the outside of the housing 4 of the impulse generator 2 arranged hoses or the like (not shown). Further, a channel 22 leading in to the propulsion device 14 and a channel 24 leading out from the propulsion device 14 are shown that are used if the propulsion device 14 is hydraulically driven. The channel 24 leading out from the propulsion device 14 is connected to the low pressure side 25 (low side). If the propulsion device 14 is driven with electricity, these channels 22, 24 are instead replaced by wires for electricity that may be located in the channels 22, 24.

If the propulsion device 14 is mechanically driven, i.e. if the propulsion device for example is a mechanical gear such as for example a gear drive, these channels 22, 24 are replaced instead by a drive shaft (not shown).

If the pulse generator 18 is hydraulically driven, the low pressure side 25 of the pulse generator 18 may as shown in the figure be connected to the low pressure side 25 of the hydraulic propulsion device 14 and with that chamber 9 which is situated on the side of the impulse piston 10 opposite the side of the propulsion chamber 6.

Figure 2:
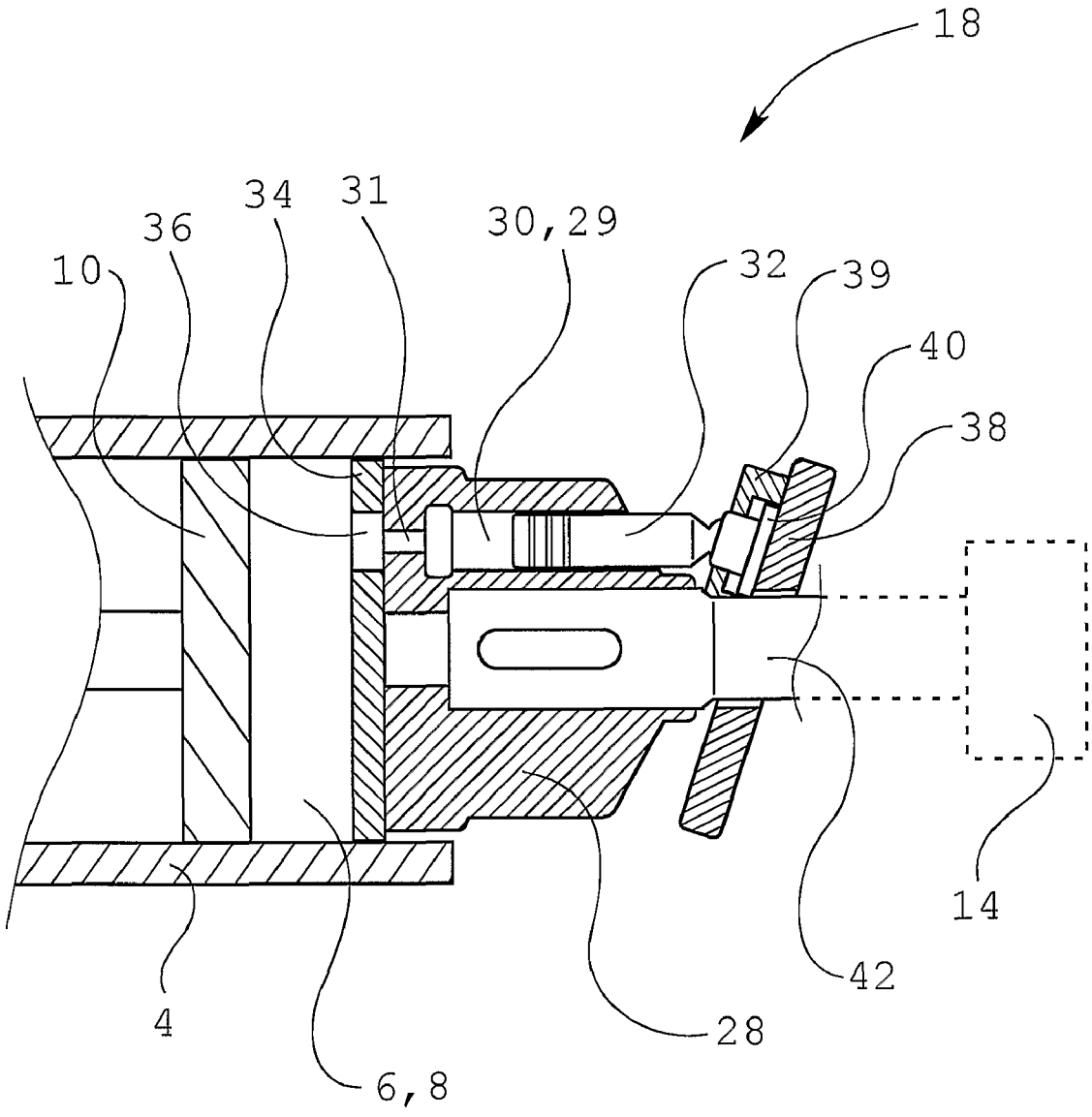
FIG. 2 shows schematically a longitudinal section of a first embodiment of the pulse generator in the impulse generator according to FIG. 1.

FIG. 2 shows schematically a longitudinal section of a first embodiment of the pulse generator 18 in the impulse generator 2 according to FIG. 1, where the pulse generator 18 comprises a rotating cylinder drum 28 with at least one piston cylinder 30, preferably more than one piston cylinder 30, and at least one piston 32, preferably more than one piston 32. The pulse generator 18 further comprises a valve disc 34 and an angled plane preferably arranged as a tilted disc 38. The pulse generator as shown in the figure extends thus between the valve disc 34 and the angled plane 38. The number of piston cylinders 30 is thus optional but has to be at least one. The generation of pulses will however to begin with be exemplified below using only one piston cylinder 30 and one piston 32, where the piston cylinder 30 and the piston 32 preferably have, but do not have to have, a circular cross section. Thus, the impulse generator 2 shown in FIG. 1 with the in FIG. 2 shown, preferably hydraulic, pulse generator 18 creates local pressure levels in at least one piston cylinder 30 by compression by means of the piston 32. The energy in each pressure peak is determined by the degree of compression in the piston cylinder 30. A relative to the housing 4 of the impulse generator 2 fixed valve disc 34 regulates via one or more therein arranged openings 36 one or more passages between the propulsion chamber 6 and an against the piston cylinder 30 connecting opening 31 in the cylinder drum 28, as well as one or more passages between the propulsion chamber 6 and the low pressure side 25 (see further below). When the piston cylinder 30 has been compressed due to the movement of the piston 32 against the volume confined in the piston cylinder 30, the in the piston cylinder 32 confined fluid is discharged rapidly towards the propulsion chamber 6 and thus towards the impulse piston 10 which experiences a pressure pulse. After the discharge, the propulsion chamber 6 is connected to the low pressure side 25 (see further below). As long as the piston 32 in the piston cylinder 30 decreases the volume of the piston cylinder 30, one may by introducing more openings 36 in the valve disc 34 create more pressure pulses in the propulsion chamber 6. In connection with each discharge, the passage/passages between the propulsion chamber 6 and the low pressure side 25 closes (see further below). When the piston 32 executes increase of the volume in the piston cylinder 30, the connection from the piston cylinder 30 to the low pressure side 25 is open, via the opening 36/openings in the valve disc 34 to the propulsion chamber 6 and the opening/openings between the propulsion chamber 6 and the low pressure side 25, with the exception of the short periods when pulses are discharged to the impulse piston 10.

The movement of the piston 32 is exact and known, preferably of sinus shape see further description below. The location of the opening 36 in the valve disc 34 and the piston stroke of the piston 32 in the piston cylinder 30 determines the compression which may be achieved in the piston cylinder 30. The piston stroke of the piston 32 may for example be varied using a tilted disc 38 which changes the degree of compression in the piston cylinder 30 whereby the pulse energy may be controlled. The pulse frequency is determined by the rotation speed of the cylinder drum 28 which is controlled by the propulsion device 14. Thus, there is no connection between pulse energy and pulse frequency. If the pulse generator 18 is driven by a propulsion device 14 in the form of a hydraulic motor arranged on the same shaft 42 as the pulse generator 18, the rotational speed may be determined by the flow in the hydraulic motor. The size (displacement) of the feeding hydraulic motor which is used determines what pressure and flow is needed to feed the motor. The motor may be adapted to available pressure—and flow levels in for example a drilling rig. If the motor is variable, one can instead obtain a flexible impulse generator 2, i.e. a drilling machine, with regard to the pressure—and flow levels in the drilling rig.

FIG. 2 thus shows an angled plane 38, preferably arranged as a tilted disc, against which the piston 32 bears via a sliding support 40. A device 39 which keeps the sliding supports against the tilted disc in those positions where the piston forces are small may be needed. The piston 32 performs a sinus shaped movement when the cylinder drum 28 and thereby the piston cylinder 30 rotates around the rotating shaft 42 of the cylinder drum 28. One half of the revolution, the piston 32 moves to the left and compresses confined fluid, or delivers flow pulses to the propulsion chamber 6. The second half of the revolution, the piston 32 moves to the right and is then connected to low pressure 25 (low side) via the propulsion chamber 6 (with the exception of the short periods when pulses are created in the propulsion chamber 6—see further below).

FIGS. 3-8 show an embodiment of a valve disc 34 fixed relative to the housing 4 of the impulse generator 2.

Figure 3:
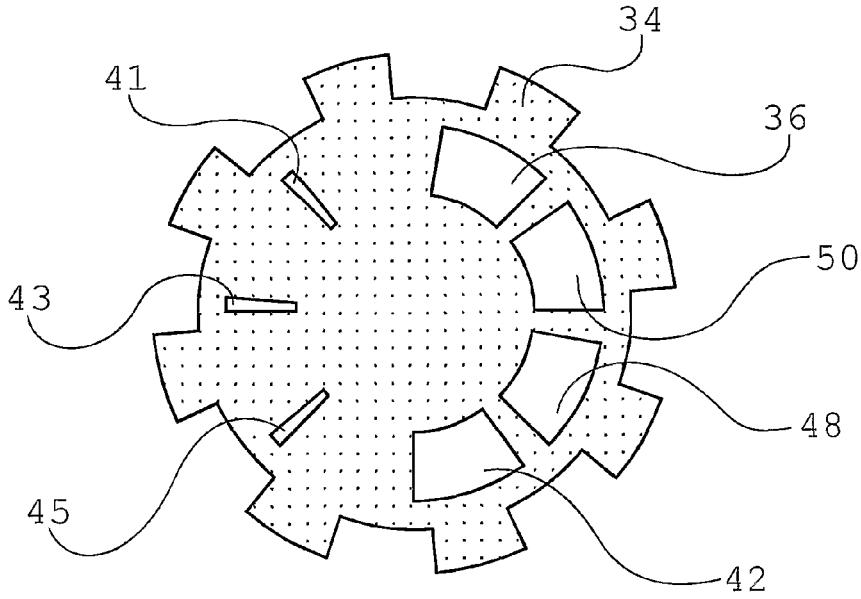
FIG. 3 shows a valve disc with openings.

FIG. 3 shows a valve disc 34 with seven openings 36, 41, 43, 45, 42, 48, 50, which openings form passages between the cylinder drum 28 and the propulsion chamber 6.

Figure 4:
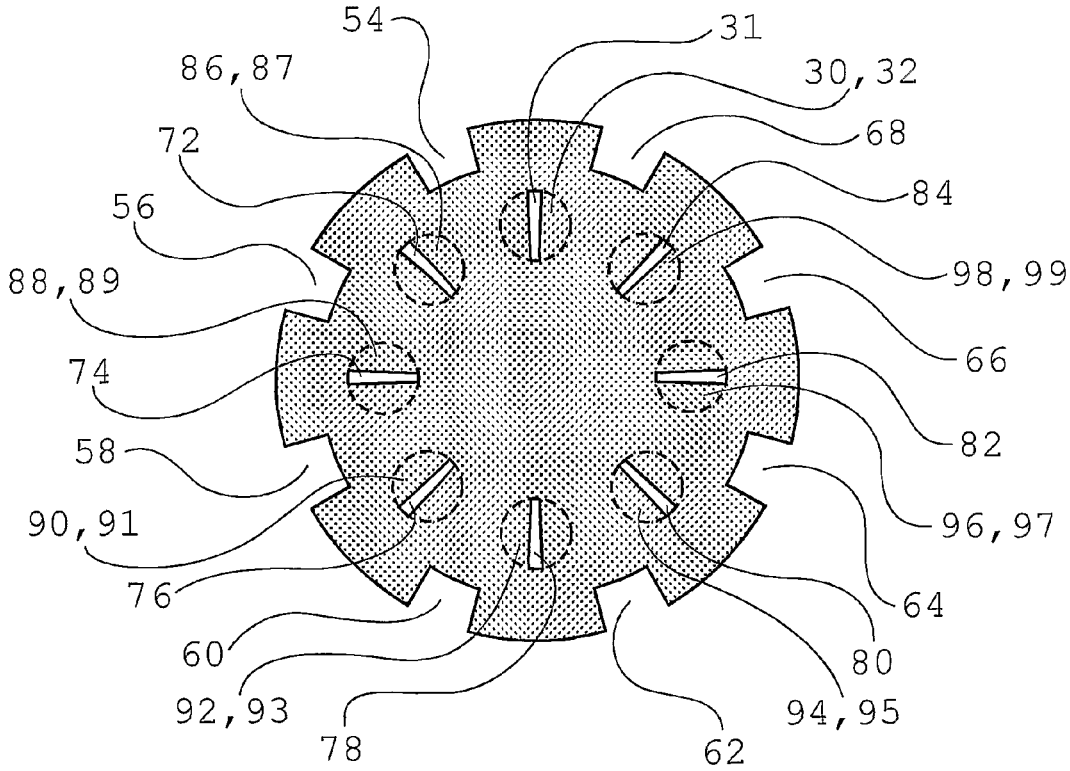
FIG. 4 shows a cylinder drum with low pressure channels, openings and piston cylinders.

FIG. 4 shows the cylinder drum 28 with in this embodiment eight low pressure connections 54, 56, 58, 60, 62, 64, 66, 68 and eight openings 31, 72, 74, 76, 78, 80, 82, 84, which openings 31, 72, 74, 76, 78, 80, 82, 84 each open into a separate piston cylinder 30, 86, 88, 90, 92, 94, 96, 98 in the cylinder drum 28. Pistons 32, 87, 89, 91, 93, 95, 97, 99 are each located in a separate piston cylinder 30, 86, 88, 90, 92, 94, 96, 98.

FIGS. 5-8 shows the valve disc 34 and the in FIGS. 5-8 behind and against the valve disc 34 beating cylinder drum 28. The cylinder drum 28 rotates to the left in the figure whereas the valve disc 34 is removably fixed in its position. During the rotation of the cylinder drum 28 compression takes place on the left half of the valve disc 34 and expansion on the right half of the valve disc 34 as mentioned above. In the embodiment shown in FIGS. 5-8, four pistons 87, 89, 91, 93 located in separate piston cylinders 86, 88, 90, 92 cooperate. By that a number of pistons cooperate by simultaneous discharges, more energy is obtained in the produced pulse. Optionally, the piston cylinders may be discharged one at a time which provides less energy in the produced pulse, but on the other hand a higher pulse frequency.

Figure 5:
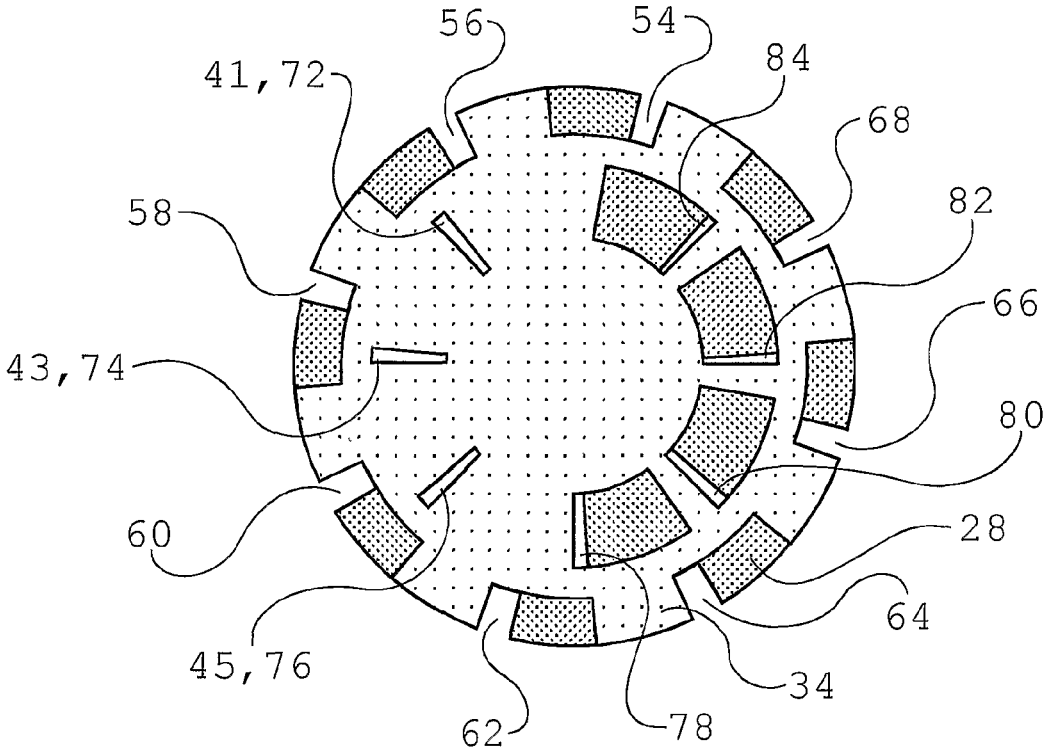
FIGS. 5-8 show the valve disc and the in FIGS. 5-8 behind and against the valve disc bearing cylinder drum in different relative positions.

FIG. 5 shows the valve disc 34 and the cylinder drum 28 in a position where the piston cylinders 86, 88, 90, 92 for the four cooperating pistons 87, 89, 91, 93, after having been exposed to compression have discharged to and created a pressure pulse in the propulsion chamber 6. As can be seen, eight openings towards the low pressure channels 54, 56, 58, 60, 62, 64, 66, 68 of the cylinder drum 28 have just opened between the valve disc 34 and the cylinder drum 28 which makes the propulsion chamber 6 to connect to low pressure 25.

Figure 6:
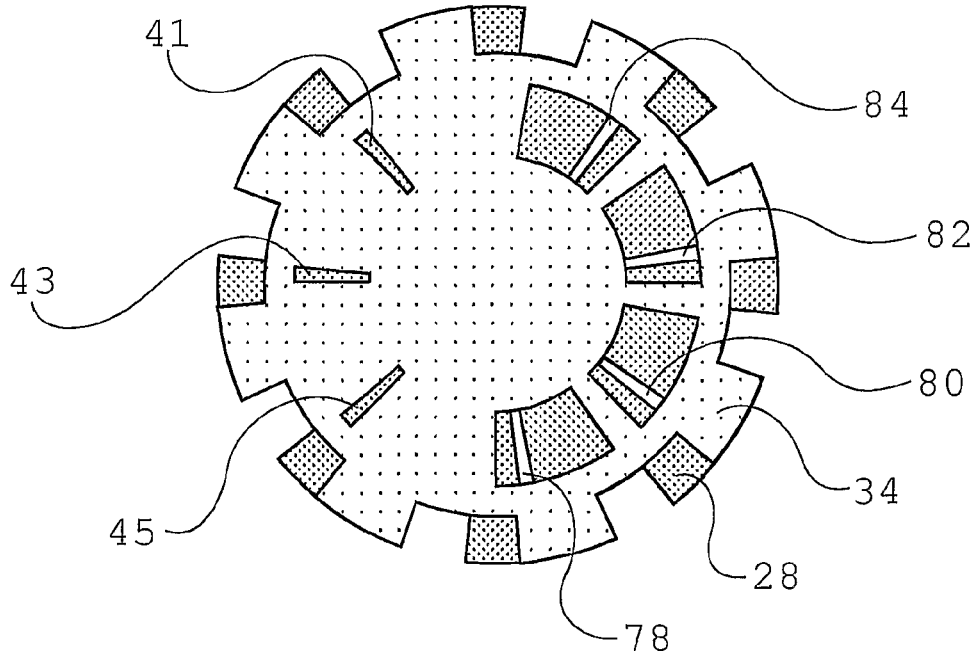

FIG. 6 shows the valve disc 34 and the cylinder drum 28 in a position where the three openings 41, 43, 45 in the valve disc 34 are closed by that they are blocked by the wall of the cylinder drum 28 whereby the fluid in the piston cylinders 30, 86, 88, 90 located behind the left half of the valve disc 34 are compressed, at the same time as the piston cylinders whose fluid expands now are connected to low pressure 25 via the low pressure channels 54, 56, 58, 60, 62, 64, 66, 68 in the cylinder drum 28, the propulsion chamber 6 and their respective openings 78, 80, 82, 84.

Figure 7:
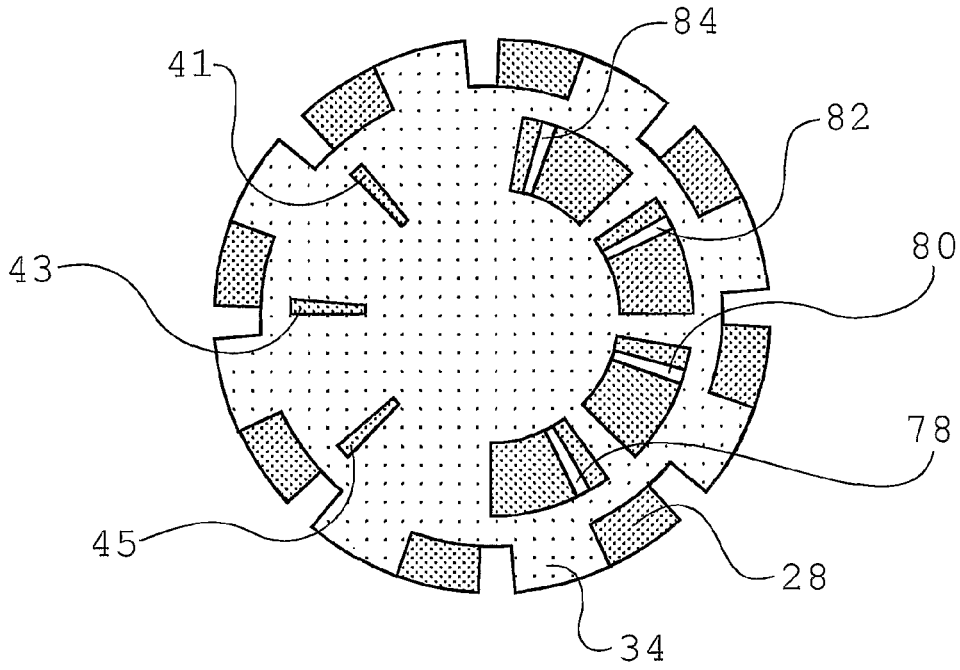

FIG. 7 shows the valve disc 34 and the cylinder drum 28 under similar pressure conditions that are shown in FIG. 6 with the difference that the cylinder drum 28 has rotated somewhat further in FIG. 7 than in FIG. 6.

Figure 8:
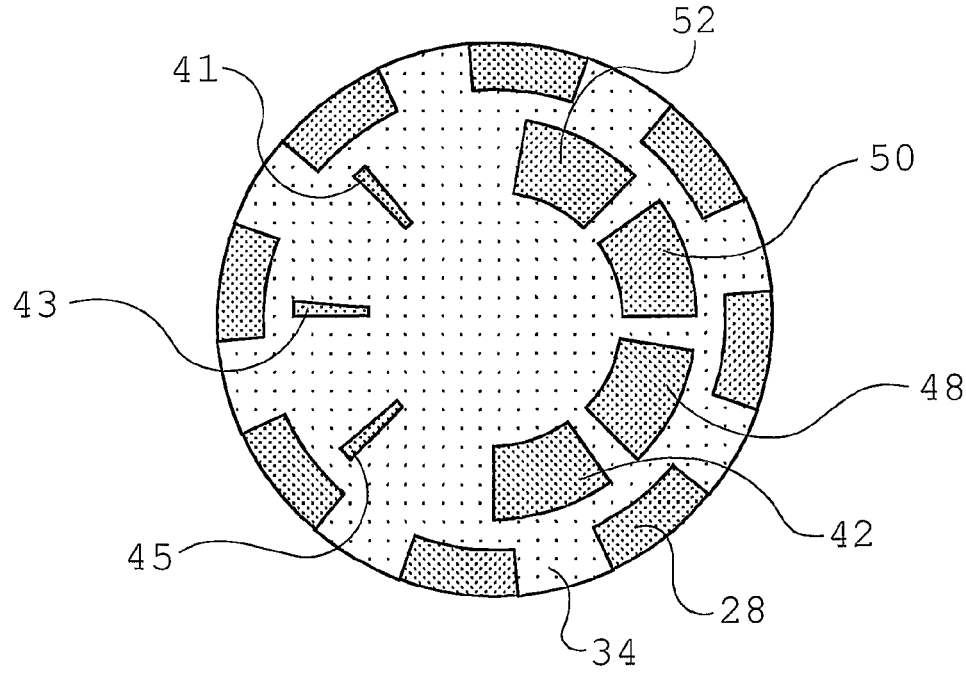

FIG. 8 shows the valve disc 34 and the cylinder drum 28 in a position just before four cooperating pistons are about to create a pressure pulse in the propulsion chamber 6. All seven openings 41, 43, 45, 42, 48, 50, 52 in the valve disc 34, and all eight openings between the valve disc 34 and the cylinder drum 28 towards the low pressure channels 54, 56, 58, 60, 62, 64, 66, 68 of the cylinder drum 28 are in this position blocked by the wall of the cylinder drum 28 in order for the pressure pulse in the propulsion chamber 6 to be maximised without losses due to leak flows or compression of the pistons that are located behind the right side of the valve disc 34. Thus, the valve disc 34 delimits in this position the propulsion chamber 6 from the low pressure side 25. If all leak flows are directed to the low pressure side 25, fluid does not have to be fed to the pulse generator 18 which results in that the pulse generator 18 may work in a closed circuit. However, circulation of fluid may be arranged if this is justified in order to attain sufficient cooling of the impulse generator. A gas accumulator (not shown) may be arranged on the low pressure side 25 in order to balance the rapid flow pulses that arise when the propulsion chamber 6 is decompressed.

The invention is described above using a valve disc. It is also conceivable to arrange radial openings in the cylinder drum which openings lead to the propulsion chamber via channels.

The pistons preferably have matched draining holes and/or draining channels (not shown) of known type for cooling and lubrication. In the fluid volume, i.e. the liquid volume, a fluid from e.g. the group: water, silicone oil, hydraulic oil, mineral oil, and non-combustible hydraulic. fluid, shall be received, but also other fluids may be conceivable. The propulsion chamber has preferably a circular cross section. The pulse generator cylinders are preferably distributed symmetrically, but optionally non-symmetrically, over the cross section area of the propulsion chamber. The impulse generator is designed to be rotationally driven. The pistons are forcedly operated by the tilted disc and the device 39 regarding both their inward-bound and outward-bound movements. Preferably, the inclination of the tilted disc may be manually or automatically altered during operation.

The invention thus relates to a pulse generator 18 in an impulse generator 2 for a rock breaking tool 12, which pulse generator 18 is intended to transfer energy from a propulsion device 14 to impulses in the tool 12, where the pulse generator 18 comprises a rotatable cylinder drum 28 comprising at least one piston cylinder 30, 86, 88, 90, 92, 94, 96, 98, in which piston cylinder 30, 86, 88, 90, 92, 94, 96, 98 is arranged at least one piston 32, 87, 89, 91, 93, 95, 97, 99, which piston 32, 87, 89, 91, 93, 95, 97, 99 is arranged to compress fluid 29 during rotation of the cylinder drum 28, and that the cylinder drum 28 is arranged to discharge the fluid 29 to the propulsion chamber 6 in the discharge position of the piston 32, 87, 89, 91, 93, 95, 97, 99 via at least one opening 31, 72, 74, 76, 78, 80, 82, 84 opening into the piston cylinder in order to produce an impulse in the tool 12.

With an impulse machine is intended for example a drilling rig for rock drilling.

It is possible to combine that which has been mentioned in the different herein described optional embodiments within the scope of the following claims.

The invention claimed is:

1. Pulse generator (18) in an impulse generator (2) for a cutting tool (12), which pulse generator (18) is intended to transfer energy from a propulsion device (14) to impulses in the tool (12), characterized in, that the pulse generator (18) comprises a rotatable cylinder drum (28) comprising at least one piston cylinder (30, 86, 88, 90, 92, 94, 96, 98), in which piston cylinder (30, 86, 88, 90, 92, 94, 96, 94) is arranged at least one piston (32, 87, 89, 91, 93, 95, 97, 99), which piston (32, 87, 89, 91, 93, 95, 97, 99) is arranged to compress fluid (29) during rotation of the cylinder drum (28), and that the cylinder drum (28) is arranged to discharge the fluid (29) to the propulsion chamber (6) in the discharge position of the piston (32, 87, 89, 91, 93, 95, 97, 99) via at least one opening (31, 72, 74, 76, 78, 80, 82, 84) opening into the piston cylinder in order to produce an impulse in the tool (12).

2. Pulse generator (18) as claimed in claim 1, characterized in, that at least one opening (41, 43, 45, 42) in a valve disc (34), relative to which valve disc (34) the cylinder drum (28) is rotatably arranged, is arranged to bear against at least one opening (31, 72, 74, 76, 78, 80, 82, 84) opening into the piston cylinder in the discharge position of the piston (32, 87, 89, 91, 93, 95, 97, 99) and form a passage between the cylinder drum (28) and the propulsion chamber (6).

3. Pulse generator as claimed in claim 2, characterized in, that a number of pistons (32, 87, 89, 91, 93, 95, 97, 99) are arranged to discharge simultaneously.

4. Pulse generator as claimed in claim 2, characterized in, that the pistons are arranged to discharge one at a time.

5. Pulse generator (18) as claimed in claim 1, characterized in, that at least one opening (31, 72, 74, 76, 78, 80, 82, 84) of the cylinder drum (28) opening into the piston cylinder is radially arranged, which opening is arranged to bear against a passage between the cylinder drum (28) and the propulsion chamber (6) in the discharge position of the piston (32, 87, 89, 91, 93, 95, 97, 99).

6. Pulse generator as claimed in claim 5, characterized in, that a number of pistons (32, 87, 89, 91, 93, 95, 97, 99) are arranged to discharge simultaneously.

7. Pulse generator as claimed in claim 5, characterized in, that the pistons are arranged to discharge one at a time.

8. Pulse generator as claimed in claim 1, characterized in, that a number of pistons (32, 87, 89, 91, 93, 95, 97, 99) are arranged to discharge simultaneously.

9. Pulse generator as claimed in claim 1, characterized in, that the pistons are arranged to discharge one at a time.

10. Pulse generator as claimed in claim 1, characterized in, that the pulse generator (18) further comprises an angled plane (38) against which at least one piston (32, 87, 89, 91, 93, 95, 97, 99) is arranged to bear during rotation of the cylinder drum (28).

11. Pulse generator as claimed in claim 10, characterized in, that the anged plane (38) is a tilted disc.

12. Pulse generator as claimed in claim 11, characterized in, that the piston bears against the tilted disc (38) via a sliding support (40).

13. Pulse generator as claimed in claim 12, characterized in, that the tilted disc (38) is arranged to be adjustable whereby the piston stroke of the piston (32, 87, 89, 91, 93, 95, 97, 99) may be varied which changes the degree of compression in the piston cylinder (30, 86, 88, 90, 92, 94, 96, 98) whereby the pulse energy may be controlled.

14. Pulse generator as claimed in claim 11, characterized in, that the tilted disc (38) is arranged to be adjustable whereby the piston stroke of the piston (32, 87, 89, 91, 93, 95, 97, 99) may be varied which changes the degree of compression in the piston cylinder (30, 86, 88, 90, 92, 94, 96, 98) whereby the pulse energy may be controlled.

15. Pulse generator as claimed in claim 1, characterized in, that the pulse generator (18) is hydraulically driven and that the low pressure side (25) of the pulse generator (18) is connected to the low pressure side (25) of the hydraulic propulsion device (14).

16. Pulse generator as claimed in claim 1, characterized in, that the pulse generator (18) is electrically driven.

17. Pulse generator as claimed in claim 1 , characterized in, that the pulse frequency of the pulse generator (18) is determined by the rotational speed of the cylinder drum.

18. Pulse generator as claimed in claim 1, characterized in, that the pulse generator (18) and the propulsion device (14) are arranged on the same shaft (42).

19. Pulse generator as claimed in claim 1, characterized in, that in the fluid volume, a fluid from e.g. the group: water, silicone oil, hydraulic oil, mineral oil, and non-combustible hydraulic fluid, is received.

20. Impulse machine, characterized in, that it comprises a pulse generator (18) as claimed in claim 1.

* * * * *